US006166309A

United States Patent [19]

Hoshino

[11] Patent Number: 6,166,309

[45] Date of Patent: Dec. 26, 2000

[54] BRIDGE MECHANISM FOR GUITAR

[75] Inventor: Yoshihiro Hoshino, Nagoya, Japan

[73] Assignee: Hoshino Gakki Co., Ltd., Japan

[21] Appl. No.: 09/505,365

[22] Filed: Feb. 16, 2000

[30] Foreign Application Priority Data

Mar. 18, 1999 [JP] Japan ..... 11-074377

[51] Int. Cl.[7] ..... G10D 3/04

[52] U.S. Cl. ..... 84/298; 84/299; 84/307; 84/312 R

[58] Field of Search ..... 84/298, 299, 307, 84/312 R, 267

[56] References Cited

U.S. PATENT DOCUMENTS 3,563,126 2/1971 Connington ..... 84/299
5,271,307 12/1993 Pollock ..... 84/298

FOREIGN PATENT DOCUMENTS 343636 3/1921 Germany .

*Primary Examiner*—Jeffrey Donels
*Assistant Examiner*—Shih-yung Hsieh
*Attorney, Agent, or Firm*—Ostrolenk, Faber, Gerb & Soffen, LLP

[57] ABSTRACT

In a bridge mechanism for a guitar, the bridge main body having a recess for the saddle and an intermediate member between at least one side of the saddle and the recess. A respective recess or concave primarily in the intermediate member directly beneath where each string passes the saddle, and second regions between the depression where the intermediate member contacts the saddle, thereby to reduce transmission of vibration of the strings to the bridge body and direct the vibrations to a pick up disposed below the saddle. In alternate embodiments, the depressions are on the saddle, there is an intermediate member on both sides of the saddle. All the depressions are in the surfaces of the recess facing the saddle.

17 Claims, 15 Drawing Sheets

【図7】

FIG. 18
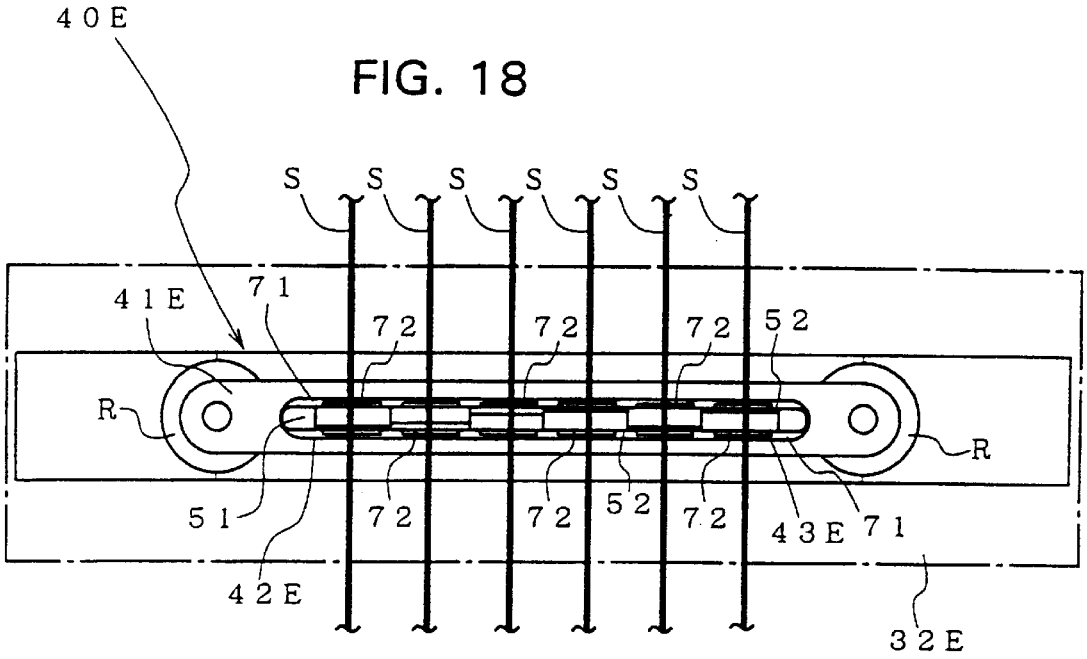
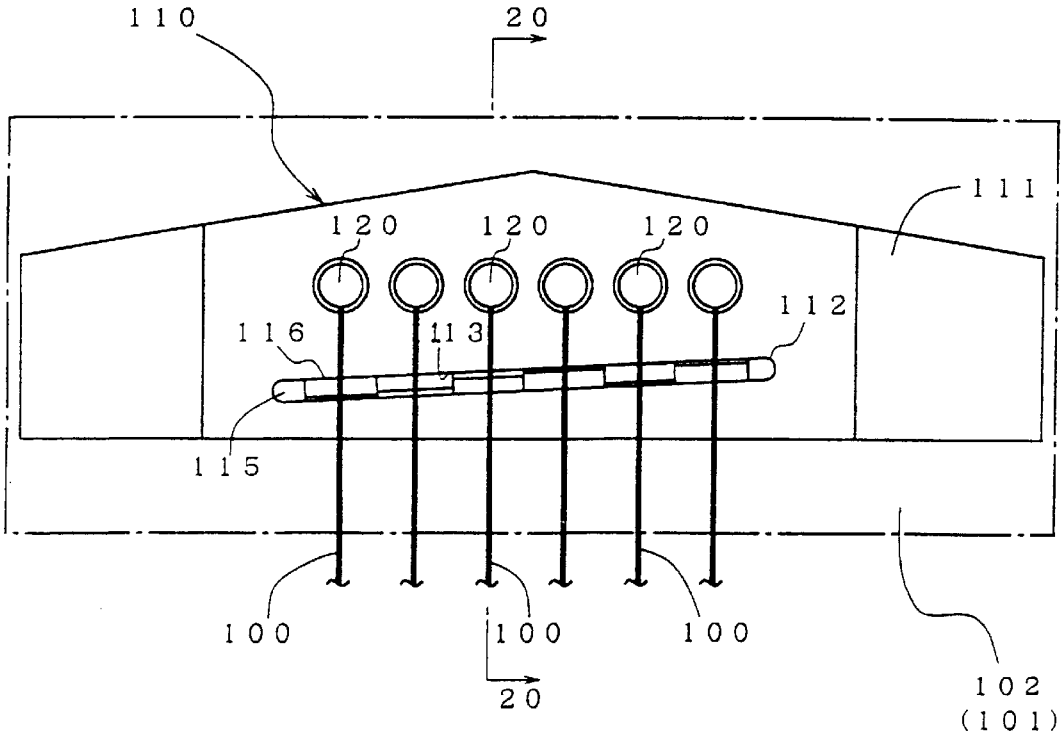
FIG. 19 PRIOR ART

FIG. 20 PRIOR ART
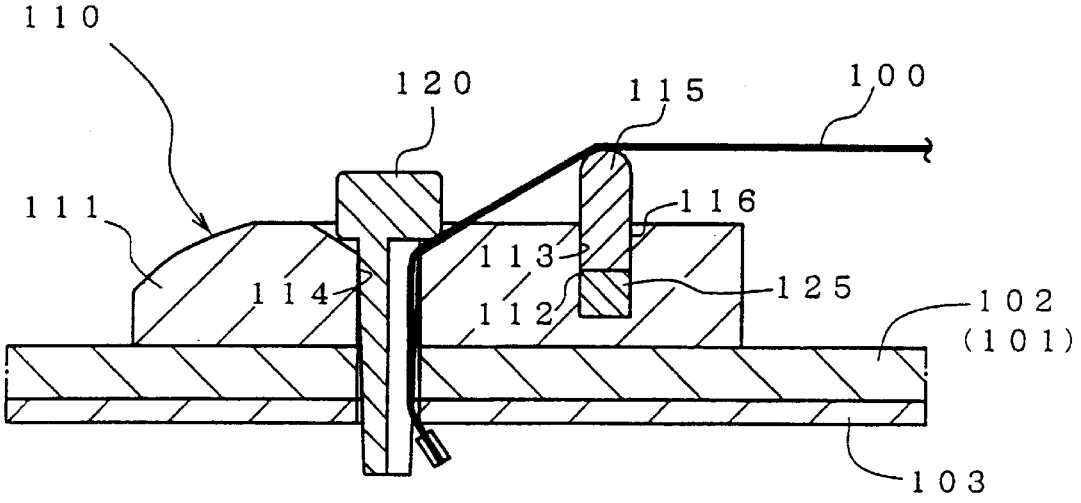
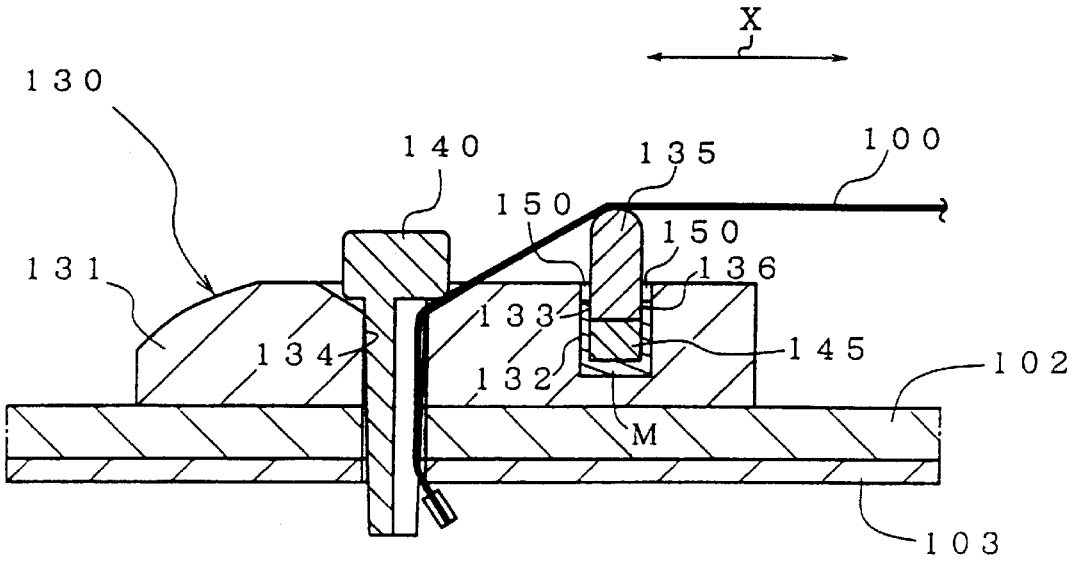
FIG. 21 PRIOR ART

BRIDGE MECHANISM FOR GUITAR

BACKGROUND OF THE INVENTION

The invention relates to the bridge of a guitar and which is equipped with a pickup of the pressure sensitive type.

DESCRIPTION OF A PRIOR ART EMBODIMENT

In a prior art acoustic guitar embodiment of FIGS. 19–21, one end of each guitar string 100 is held by a bridge 110 that is on the surface of the table 102 of the guitar body 101 and the other end of the string is wound to stretch on a tuning bolt, not shown, at the head of the guitar.

The bridge 110 includes a main bridge body 111 arranged on the surface of the table 102 of the body and a string support or saddle 115 that supports each guitar string 100 from below. A bridge plate or bridge pad 103 re-enforces the table 102. The saddle is arranged inside an accommodating recess 112 formed in the main bridge body 111. Beyond that region of each string that is supported by the saddle 115, the end of each guitar string 100 is integrally fixed in a string stopping hole 114 of the main bridge body 111 by a respective one of a plurality of fixing pins 120, each located toward the end of the guitar string 100 that is supported by the bridge 115.

As the bridge 110 is used on a flat-top surface guitar, there is a relatively small distance between the guitar strings and the guitar body in an acoustic guitar, the main bridge body 111 is fixed to the surface of the table 102 by simple means such as glueing, etc. For an arch-top guitar, etc. on the other hand, where the distance between the guitar string and the guitar body may be comparatively large, the bridge is often equipped with a vertical adjustment mechanism, which can adjust the height of the string.

Recently, it has become possible to incorporate a pressure sensitive type pickup, such as a piezo pickup, including a pressure sensitive element under the string support or saddle 115 of the bridge 110, as shown in FIG. 20. The pressure sensitive pickup 125 contracts or elongates by vibrations of the guitar string, which are transmitted through the saddle 115, with the piezo pickup generating an electric signal and that signal being extracted at a pickup output, producing an electric sound.

There is also a pickup of the electromagnetic type, i.e., a magnetic pickup, for generating an electromotive force by the electromotive induction of the guitar strings, with a coil and a magnet being provided, rather than a pickup output by a piezo pickup 125 of the pressure sensitive type. The magnetic pickup is incorporated into the guitar body.

Where a pressure sensitive type pickup 125 is used, a sharp stand-up of the sound is produced for the physical pickup of the string vibrations, and the attenuation is smooth. Even sounds generated by non-metal, e.g. nylon, etc., strings which are not magnetic, can also be picked up. In addition, since no coil is used in a pressure sensitive, e.g. piezo pickup, as contrasted with an electromagnetic pickup, there is no pick-up of an induction noise.

In a prior art bridge 110 which is equipped with a pickup 125 of the pressure sensitive type, however, the forward side 116 of the string support saddle, excluding that part which protrudes above the surface of the main bridge body 111, is in direct contact with the inner wall surface 113 of the accommodating recess 112 for the bridge in the main bridge body 111.

A large portion of the vibrations of the guitar strings 100 is transmitted from the side surface 116 of the saddle to the main bridge body 111 in the vicinity of the guitar string 100, specifically at a location approximately right under each guitar string, so that only part of the string vibrations are transmitted to the pressure sensitive pickup. This causes a problem in the efficiency of the transmission of the string vibrations to the pickup 125 of the pressure sensitive type which has not been satisfactory.

FIG. 21 shows one prior art solution to the above-described problem. A gap 150 may be left between the inner wall surface 133 of the accommodating recess 132 for the string support saddle of the main bridge body 131 and the side wall 136 of the string support saddle 135 by slightly increasing the distance between the opposing inner wall surfaces 133 of the recess 132 for the string support saddle as compared with the front to rear thickness of the string support saddle 135 and by depositing a resin M between the string support saddle 135 and the pressure sensitive pickup 145 and the accommodating recess 132 for the saddle.

However, the installation strength stability of the string support saddle 135, as compared with the main bridge body 131, is insufficient. An added disadvantage is the deterioration of the resin layer M over time or its lack of strength against the force that is applied in the direction X due to the tensile strength of the strings, through the string support saddle 135. The layer of resin M is crushed, and the string support saddle 135 tilts in the direction X of the tensile force of the string, causing contact between the side wall 136 of the string support saddle 135 and the inner wall surface 133 of the accommodating recess 132 for the string support member, and string vibrations arc transmitted from the saddle to the main bridge body 131 where they contact.

In FIG. 21, there is a table 102 of the guitar body, a re-enforcing bridge plate or bridge pad 103 for the table 102, a bridge 130, a string stop hole 134 formed in the main bridge body 131 and a respective fixing pin 140 for fixing each guitar string 100.

SUMMARY OF THE INVENTION

The present invention is proposed to overcome the above-described circumstances. It provides a bridge for a guitar which has a pickup of the pressure sensitive or piezo type, wherein the efficiency of the transmission of the string vibrations to the pressure sensitive pickup is high.

The invention relates to a bridge for a guitar which comprises a main bridge body which is arranged on the surface of a guitar body and which has an accommodating recess for a string support member or saddle, and a string support member or saddle arranged in the accommodating recess for the supporting each guitar string. A pressure sensitive type or piezo pickup is arranged to contact the string support member or saddle from below and detects the vibrations of each guitar string. An intermediate member is interposed between the inner wall surface of the accommodating recess for the saddle on the main bridge body and the side of the saddle. The intermediate member has a non-contact part at a location which is approximately immediately below at least each guitar string and that part does not contact the side of the saddle.

In particular, the bridge includes a concave part that does not contact the side of the string support member or saddle and that is provided approximately immediately below at least each guitar string and on the inner wall of the accommodating recess for the saddle.

In addition, the bridge for a guitar comprises a concave part on the side of the saddle which contacts the inner wall surface of the recess for the saddle so that the portions of the saddle which are approximately immediately below at least each guitar string on the side of the saddle may not contact the inner wall surface of the recess for the saddle.

Other objects and features of the invention are explained below with reference to the attached drawings.

BRIEF DESCRIPTION OF THE DRAWINGS

FIG. 18 is a plan view of the bridge mechanism.

FIG. 19 is a plan view of a bridge mechanism according to prior art.

FIG. 20 is a cross section along line 20—20 in FIG. 19.

FIG. 21 is a cross section of another embodiment of a prior art bridge mechanism.

DESCRIPTION OF A PREFERRED EMBODIMENT

Figure 1:
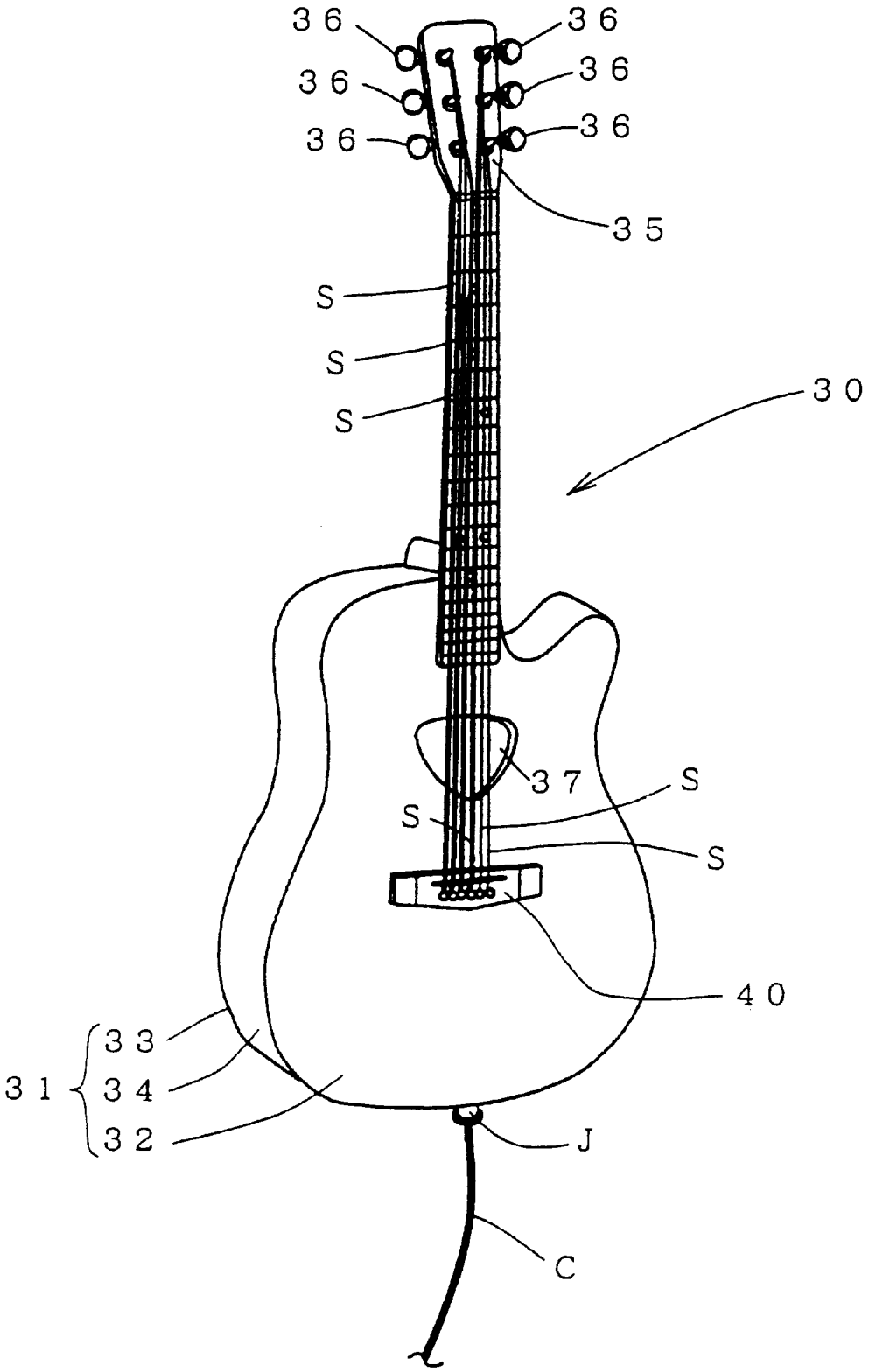
FIG. 1 is an oblique view of an entire acoustic guitar equipped with a bridge mechanism according to an embodiment of the invention.

FIG. 1 shows an acoustic guitar 30 which is provided with a first embodiment of a bridge mechanism 40. This acoustic guitar generates its tone color by the resonance of the guitar body 31, in which the front table surface 32, the rear table surface 33 and the side plate 34 of the guitar body 31 define a hollow resonance box for the resonant amplification of the vibration sounds of a plurality, e.g., six guitar strings S.

In this acoustic guitar 30, moreover, one end of each guitar string S is held by a respective tuning bolt 36 at the head 35 of the guitar. The other end of the string is stretched as it is held by the first embodiment of a bridge 40 arranged on the table surface 32. There is a sound hole 37 in the surface 32.

This acoustic guitar is classified as a flat-top guitar where the distance between the guitar strings and the table surface 32 of the guitar body 31 is comparatively small.

Figure 2:
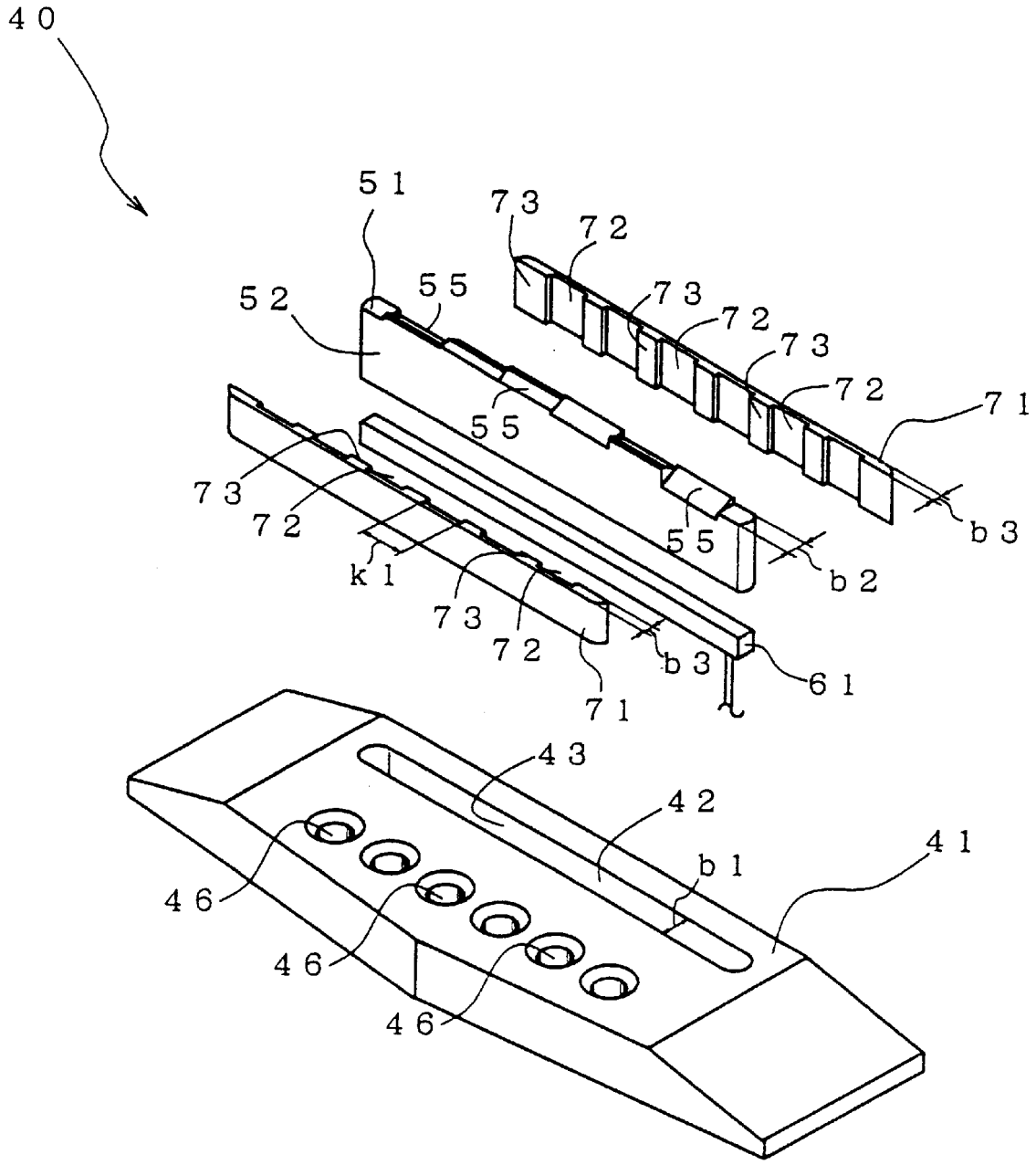
FIG. 2 is an oblique dismantled view of the bridge mechanism.
Figure 3:
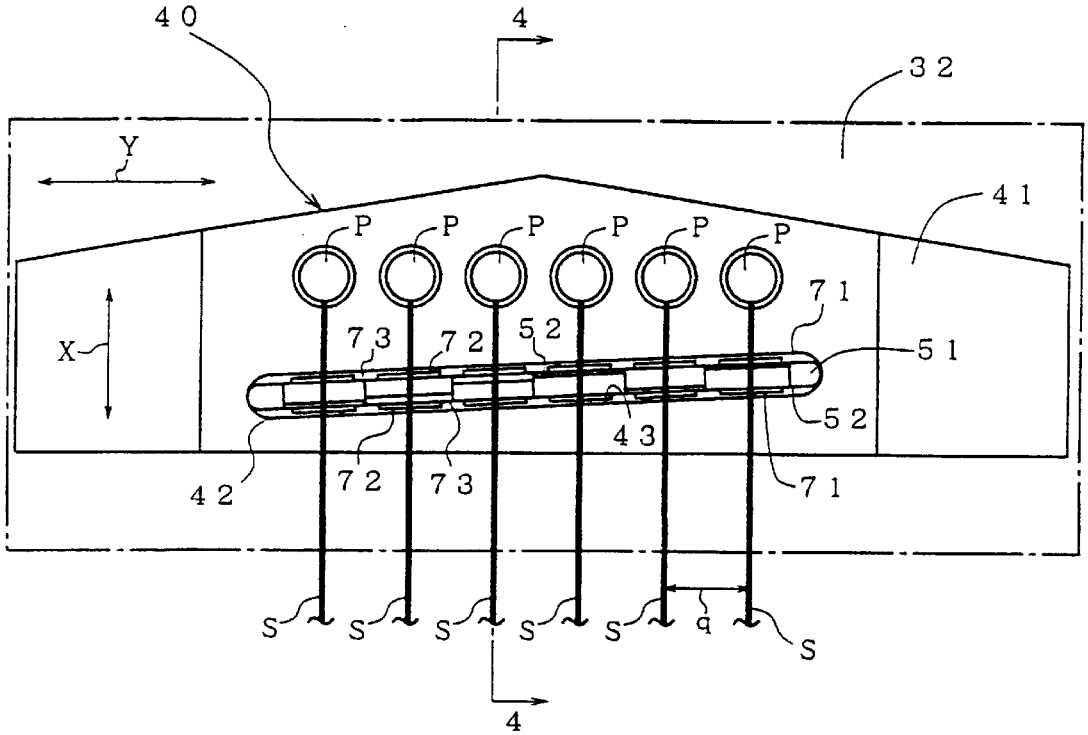
FIG. 3 is a plan view of the bridge mechanism.
Figure 4:
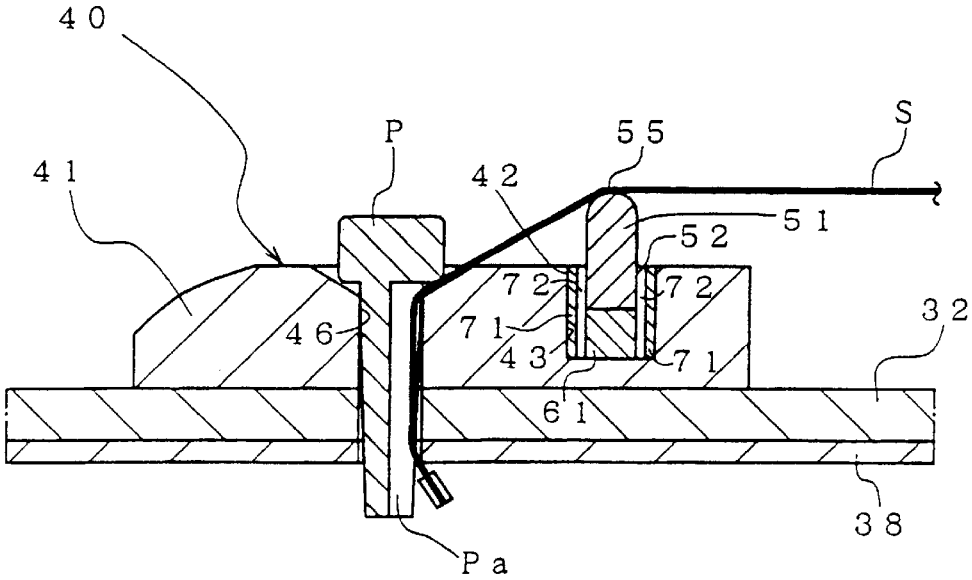
FIG. 4 is a cross section of the bridge mechanism along line 4—4 in FIG. 3.

The bridge mechanism 40 is designed to convert the vibrations of the guitar strings into an electric signal and outputs the electric signal to produce an electric sound. As is shown in FIGS. 2 through 4, the bridge comprises a main bridge body 41, a string support member or saddle 51, a pickup 61 of the pressure sensitive type, e.g., a piezo, and intermediate members 71 at both lateral sides of the saddle. In FIG. 4 a bridge plate bridge pad 38 re-enforces the table surface 32.

The main bridge body 41 installs the bridge mechanism 40 on the surface of the table 32 of the guitar body 31. The main bridge body 41 is oblong in the width direction directly across the direction X of the tensile force of the guitar strings S, and is made of a plate of wood, etc. Its back side is fixed to the table surface 32 by suitable means, such as gluing with a binding material or fixing with a bolt, etc.

In addition, an accommodating recess 42 for the string support member or saddle 51 described below, is provided in the front of the main bridge body 41. A plurality of string stopper holes 46, six holes in this example, are provided at locations which correspond to the guitar strings S to the rear of the accommodating recess 42.

The recess 42 for the string support saddle comprises a groove which is oblong in the width direction Y across the guitar strings S. However, it is not limited to this. It is also possible to orient the accommodating recess for the string support saddle as a space which is partitioned or is surrounded by a plurality of walls erected on the surface of the main bridge body, for instance.

The string support saddle 51 supports the guitar strings S. It is made of a synthetic resin, e.g. urea resin, etc. or of cow bone, etc. The saddle 51 is disposed inside the recess 42 for the saddle in the main bridge body 41. In this embodiment, the string support saddle 51 is comprised of a single plate and has a plurality of string contact regions 55, e.g. six string contacts, each corresponding to one of the guitar strings S.

The end of each guitar string S that is supported on the saddle 51 is fixed in a string stopper hole 46 formed in the main bridge body 41 by a respective one of a plurality of fixing pins P. The known fixing pin includes a cut Pa in the axial direction for accommodating the string. One end of the guitar string S is inserted into the string stopper hole 46 of the main bridge body 41 along with the fixing pin P. The guitar string S is held and fixed between the string stopper hole 46 and the fixing pin P.

The pickup 61 is of the pressure sensitive type and has the purposes of detecting vibrations of the guitar strings S, to convert the string vibrations into an electric signal and to output that as a pickup output i.e., an electric sound. The pickup comprises a known pressure sensitive element 61 arranged below the string support saddle 51 so as to contact the saddle.

The pressure sensitive pickup 61 generates an electric signal through contracting and elongating which is caused by vibrations of the guitar strings S that are transmitted through the string support saddle 51, thereby producing a pickup output. The quality of the sound that is produced is sharp and its attenuation is smooth. At the same time, it can accommodate vibrations of strings which are made of materials, like nylon, etc. which are not of a magnetic substance.

The pickup 61 of the pressure sensitive type is connected to a circuit plate, etc. not shown, through a lead wire not shown, and is further connected with an electric device like an amplifier, etc. through a jack J or a cable C (FIG. 1).

An intermediate member 71 increases the transmission efficiency of the string vibrations from the guitar string S to the pressure sensitive pickup 61 and, at the same time, firmly fixes the string support saddle 51 in the string support saddle accommodating recess 42 of the main bridge body 41. The intermediate member 71 is interposed between the inner wall surface 43 of the recess 42 for the saddle of the main bridge body 41 and the side surface 52 of the string support saddle 51.

In this embodiment, a pair of intermediate members 71 is arranged on both the front and rear sides of the string support saddle 51. However, it is possible to arrange one intermediate member 71 on either side of the string support saddle 51. Nevertheless, it is desirable to arrange the intermediate members 71 on both sides of the string support saddle 51 as in this example so as to ensure increased propagation efficiency of the string vibrations.

The intermediate members 71 are thin plate bodies. The thickness b3 of the intermediate member 71 (the length in the direction X of the tensile strength at the contact part 13 which will be described later) is determined in consideration of the distance b1 between the inner wall surfaces 43 of the accommodating recess 42 for the string support saddle of the main bridge body 41 as well as the thickness ba of the string support saddle 51.

Facing the side wall of the string support saddle, the intermediate member 71 has non-contact regions 72, which do not contact the side surface 52 of the string support saddle. The parts 72 are provided at least at the positions which are approximately immediately below each guitar string S. In this example, each non-contact part 72 of an intermediate member comprises a concave region of a prescribed width k1. The width k1 of the non-contact part 72 permits a minute deformation in the direction X of the string's tensile strength of the part of the string support saddle which is in the vicinity of the guitar string of the string when the string is vibrated, and that width is further determined such that the strength of the contact part 73 of the intermediate member 71 which contacts the side 52 of the string support or the stability of the string support saddle 51 against the main bridge body 41 may become sufficient. In particular, the width k1 is set above one half the pitch q between the strings.

In this example, moreover, the center of the non-contact part (the concave region) 72 in the width direction is positioned approximately right under each string S of the guitar.

When the gap between the string support saddle 51 and the intermediate member 71 is located approximately precisely below each guitar string S by non-contact part 72 not contacting the side surface 52 of the string support saddle at a location which is approximately directly below at least each guitar string of the intermediate member 71, as described above, it is possible to reduce the damping of the string vibrations by the main bridge body 41, thereby markedly improving the propagation efficiency of the string vibrations to the pressure sensitive type pickup 61.

There are no special limitations on the materials of which the intermediate member 71 may be comprised. However, it is desirable to use a metal, etc. with rigidity high enough that the strength of the intermediate member 71 against the tensile force of the guitar string S (strength against the force that works in the direction X of the tensile strength of the string support member 51) is sufficient. At the same time, the amount of the leakage or damping of the string vibrations from the intermediate member 71 to the main bridge body 41 can be further reduced.

Figure 5:
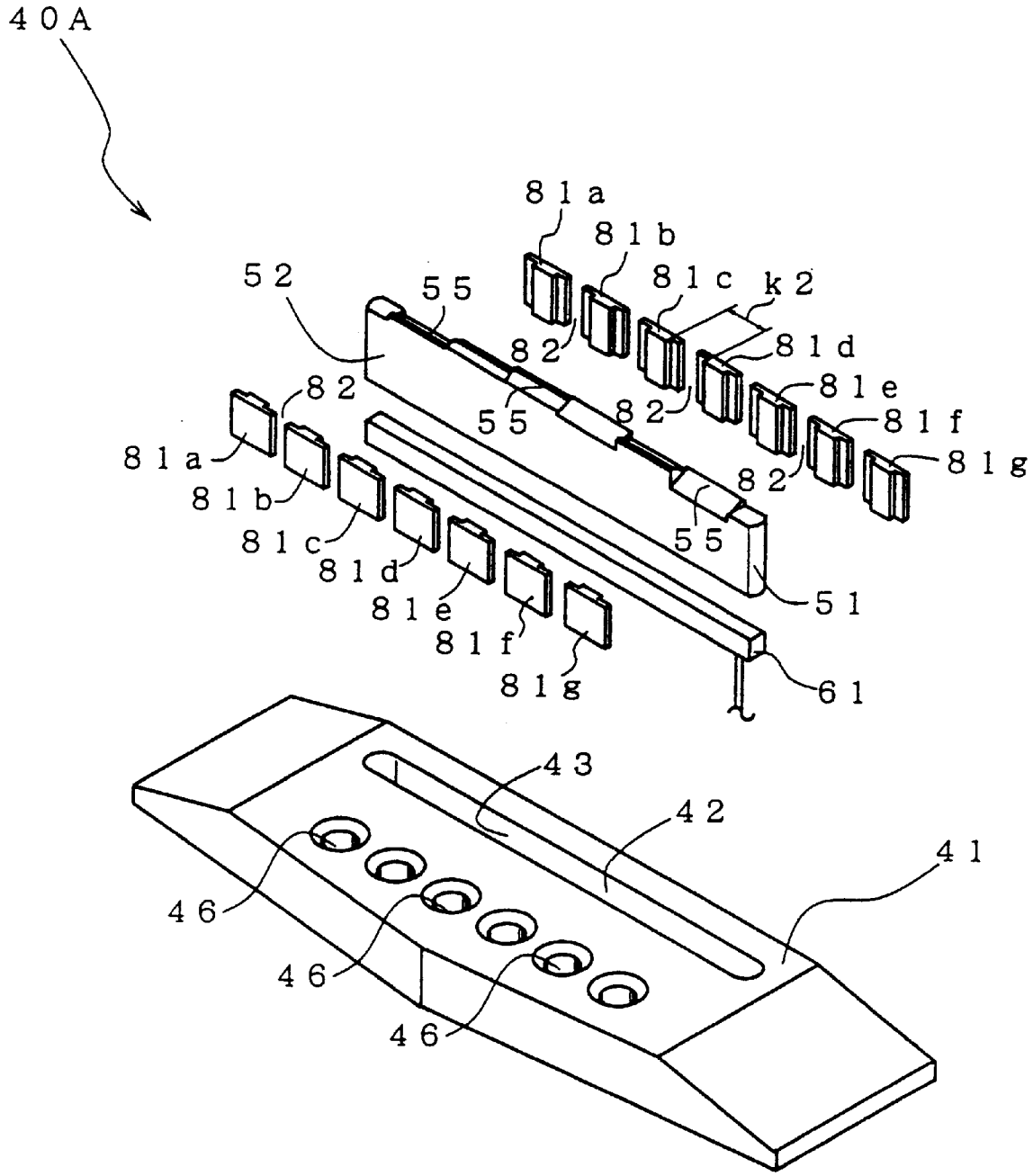
FIG. 5 is an oblique dismantled view of another embodiment of a bridge mechanism.
Figure 6:
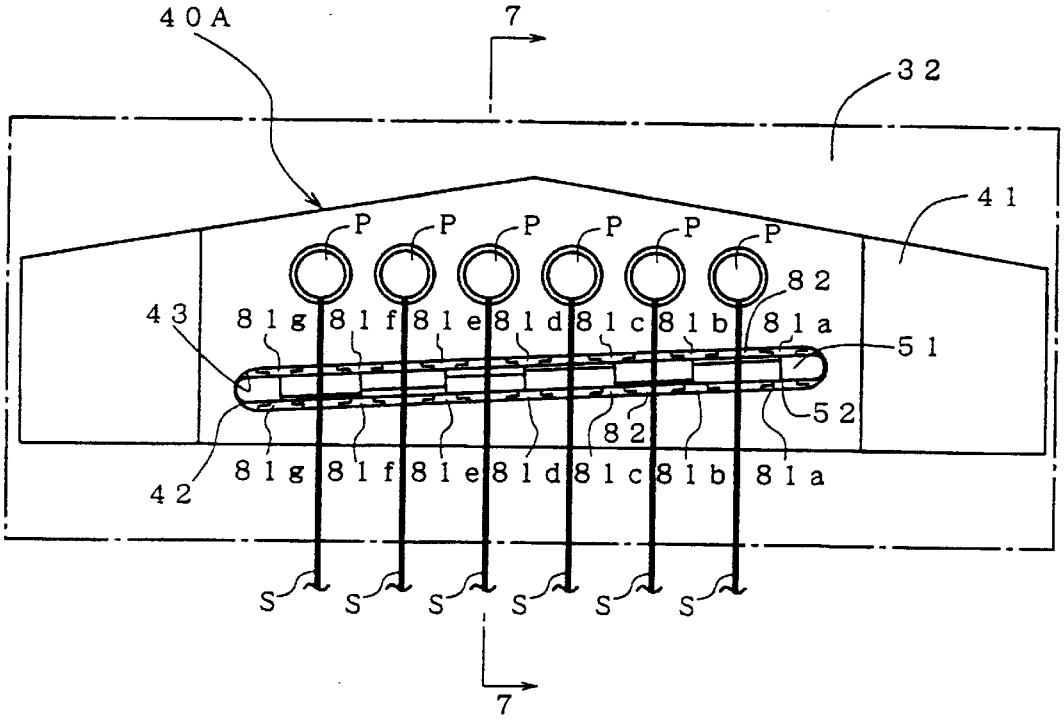
FIG. 6 is a plan view of the bridge mechanism.
Figure 7:
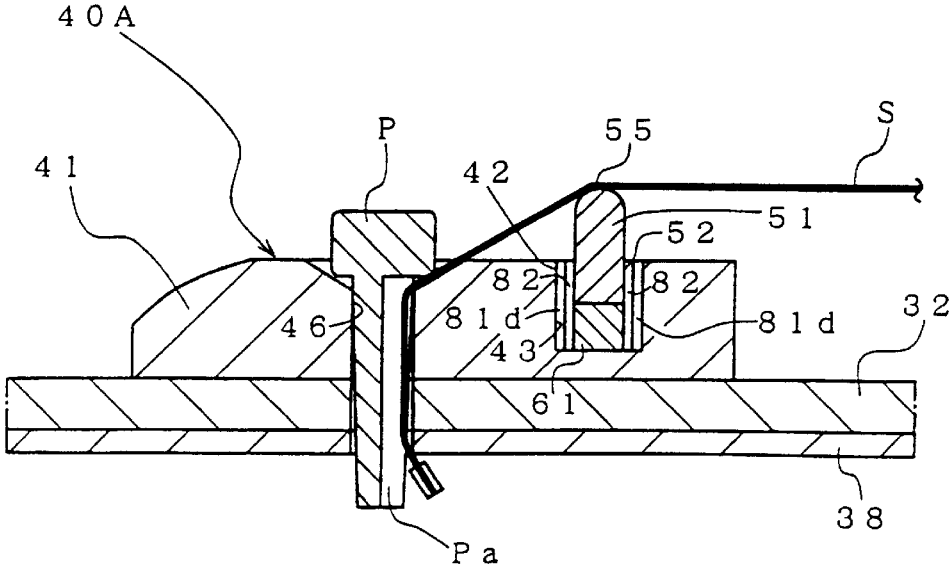
FIG. 7 is a cross section along line 7—7 in FIG. 6.

FIGS. 5 through 7 show another embodiment of a bridge mechanism 40A. As the bridge mechanism 40A has approximately the construction of the bridge mechanism 40 of FIGS. 2 through 4, except for the intermediate member, no explanation is provided as to the same elements. The differentiating features of the bridge mechanism 40A are explained below.

The bridge mechanism 40A has a suitable number (seven on each side, for a total of 14 in the example shown) of intermediate members 81*a* through 81*g* interposed at a prescribed distance between the inner wall surface 43 of the accommodating recess for the string support saddle of the main bridge body 41 and the side surface 52 of the string support saddle 51. These intermediate members 81*a* through 81*g* have convex cross sections toward the saddle 51.

The intermediate members are not to be limited to such illustrated shape. If the shape shown in the Figure is used, however, the contact area between the intermediate members 81*a* through 81*g* and the inner wall surface 43 of the accommodating recess of the string support saddle of the main bridge body 41 is larger or wider than the contact area of the intermediate members 81 a through 81 g with the string support saddle 52. Even when the main bridge body 41 is made of a softer material, like wood, etc., it becomes difficult for the intermediate members 81*a* through 81*g* to sink into the wall surface 43 of the accommodating recess 42.

In this example, the gaps between the intermediate members 81 define the non-contact regions 82 of a prescribed width k2 that do not contact the side wall 52 of the string support saddle. Here, the non-contact regions 82 are set at least approximately right below each guitar string S.

The width k2 of the non-contact regions 82 is determined to permit minute deformation of the string support member 51 in the direction of the strings' tensile force in the vicinity of the guitar string when the string vibrates. This makes it possible to reduce the amount of damping or leakage of the string vibrations to the main bridge body 41 like the bridge mechanism 40, increasing the propagation efficiency of the string vibrations to the pressure sensitive pickup 61 when the strings vibrate.

Figure 8:
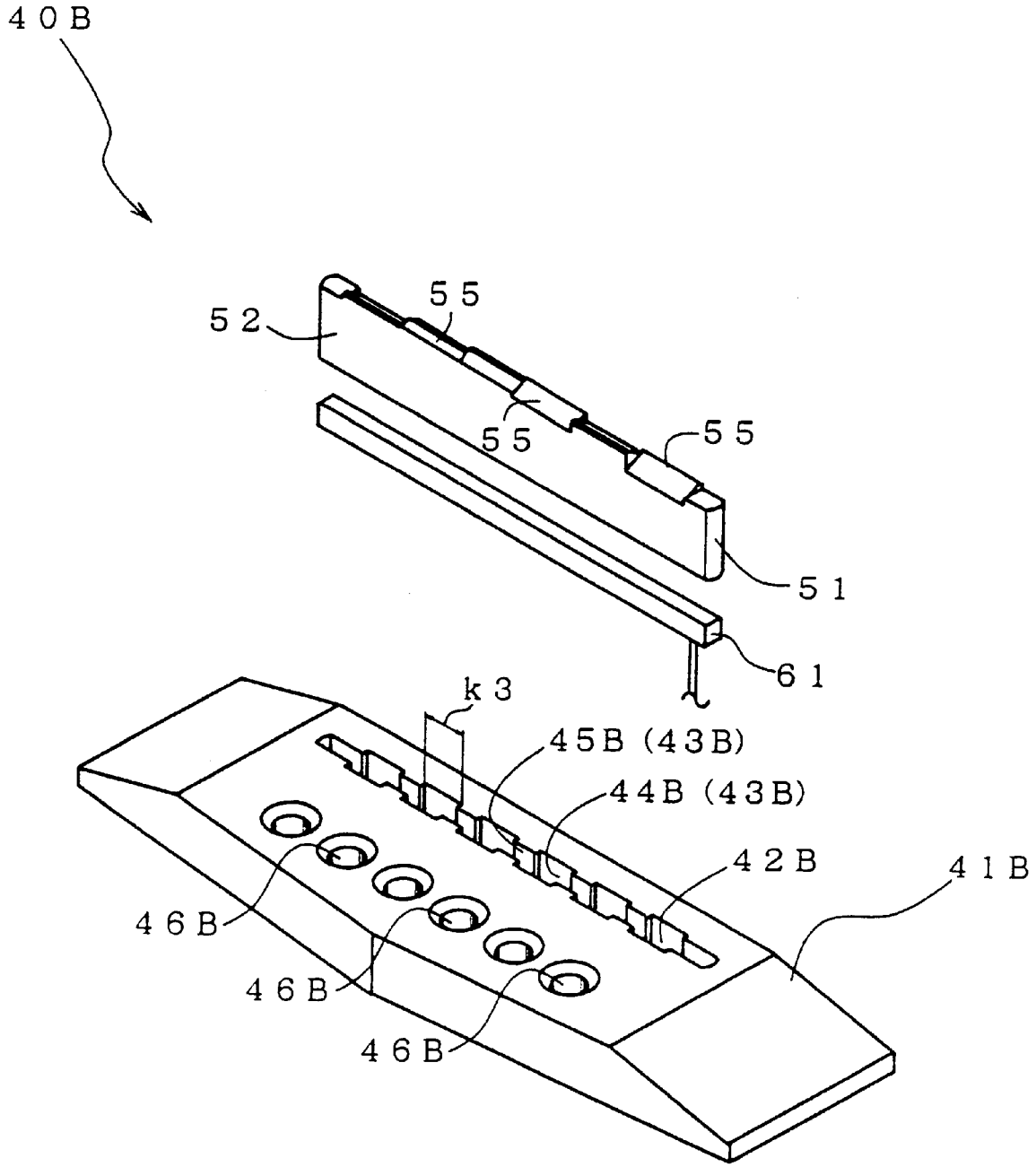
FIG. 8 is an oblique dismantled view of a third embodiment of a bridge mechanism.
Figure 9:
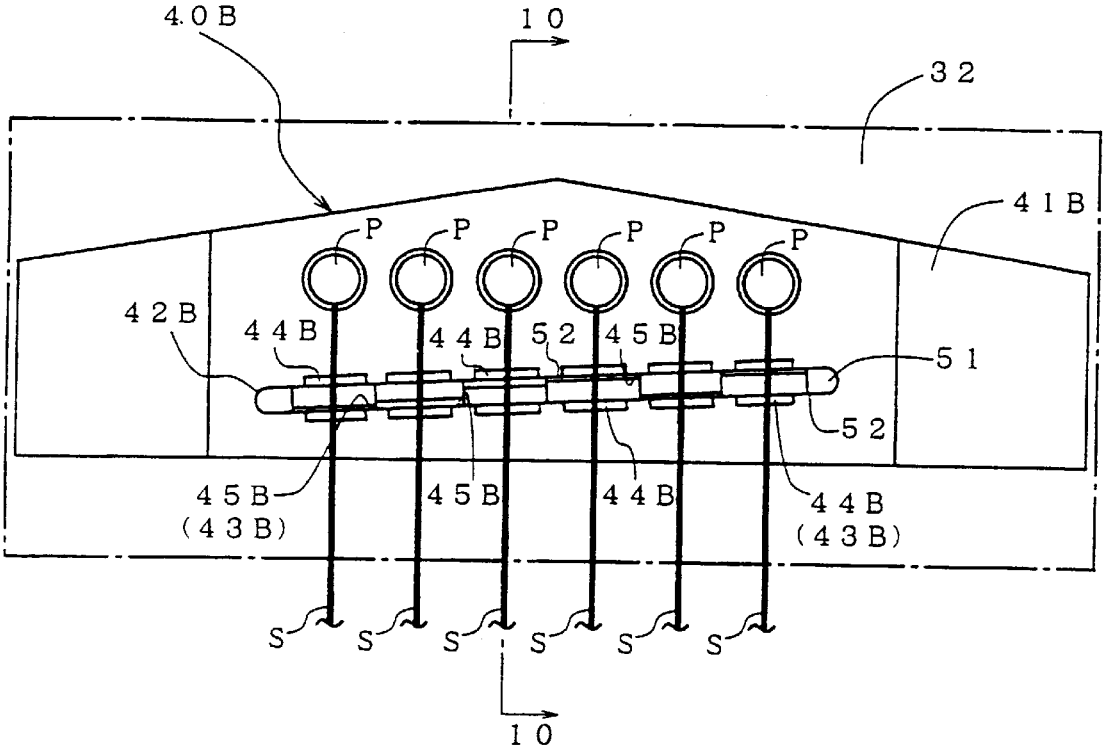
FIG. 9 is a plan view of the bridge mechanism.
Figure 10:
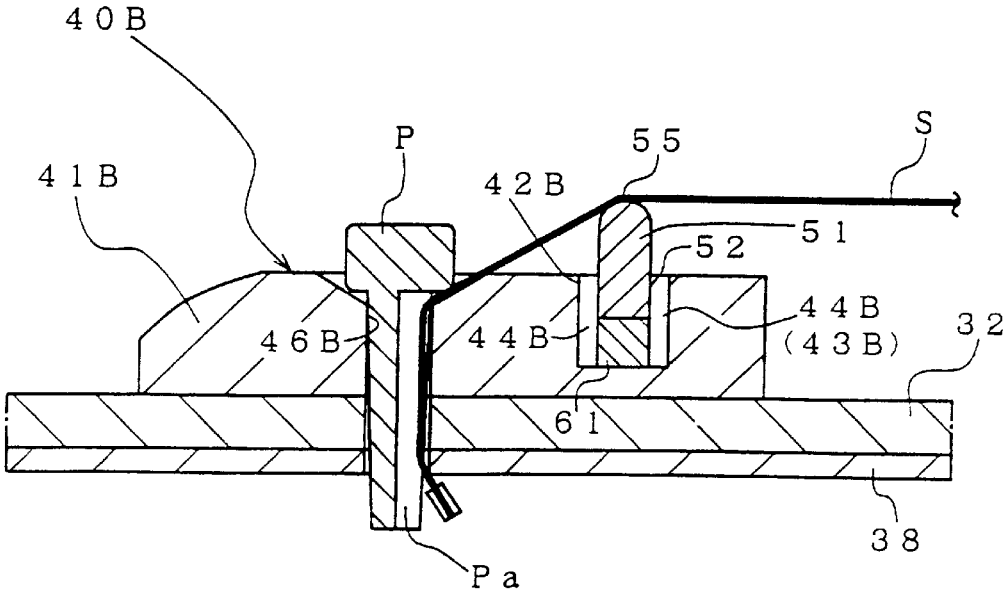
FIG. 10 is a cross section along line 10—10 in FIG. 9.

Another embodiment of bridge mechanism 40B in FIGS. 8 through 10 comprises a main bridge body 41B, a string support saddle 51 and a pickup 61 of the pressure sensitive type. In FIGS. 8 through 10, those elements which are the same as in the bridge mechanism 40 of FIGS. 2 through 4 are not described, and the different features are explained below.

In the bridge mechanism 40B, concave regions part 44B of a prescribed width k3 that do not contact the side 52 of the string support saddle 51 are provided approximately directly below at least each guitar string S in the opposite inner wall surfaces 42B of the accommodating recess 42B for the string support saddle in the main bridge body 41B. The parts 45B between the concaves 44 contact the sides 52 of the string support saddle, thereby holding or fixing the string support saddle 51.

The width k3 of each concave region 44B permits a minute deformation in the direction of the string's tensile strength at the sections of the string support saddle 51 in the vicinity of the guitar strings when the strings are vibrated while the strength of the contact part 45B against the side 52 of the string support saddle on the part of the main bridge body 41B is sufficiently high. A string stopper hole 46*b* is at the rear of the accommodating recess 42B for the string support saddle.

The bridge mechanism 40B reduces the damping or the leakage of the vibrations of the string to the main bridge body 41B, like the bridge mechanisms 40 20 and 40A. This improves the propagation efficiency of the string vibrations to the pressure sensitive pick up 61. At the same time this embodiment reduces the number of the parts used.

Figure 11:
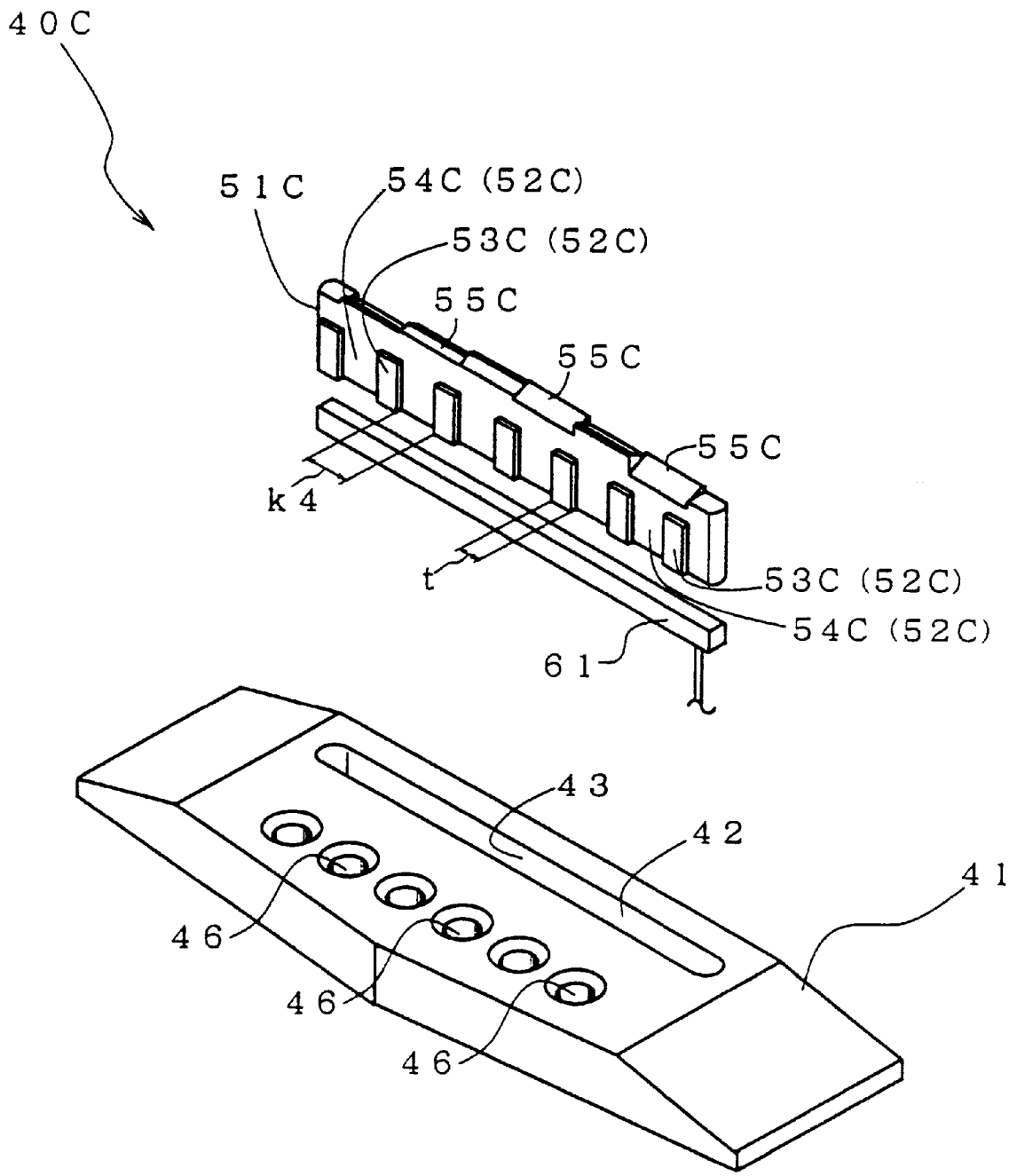
FIG. 11 is an oblique dismantled view of a fourth embodiment of a bridge mechanism.
Figure 12:
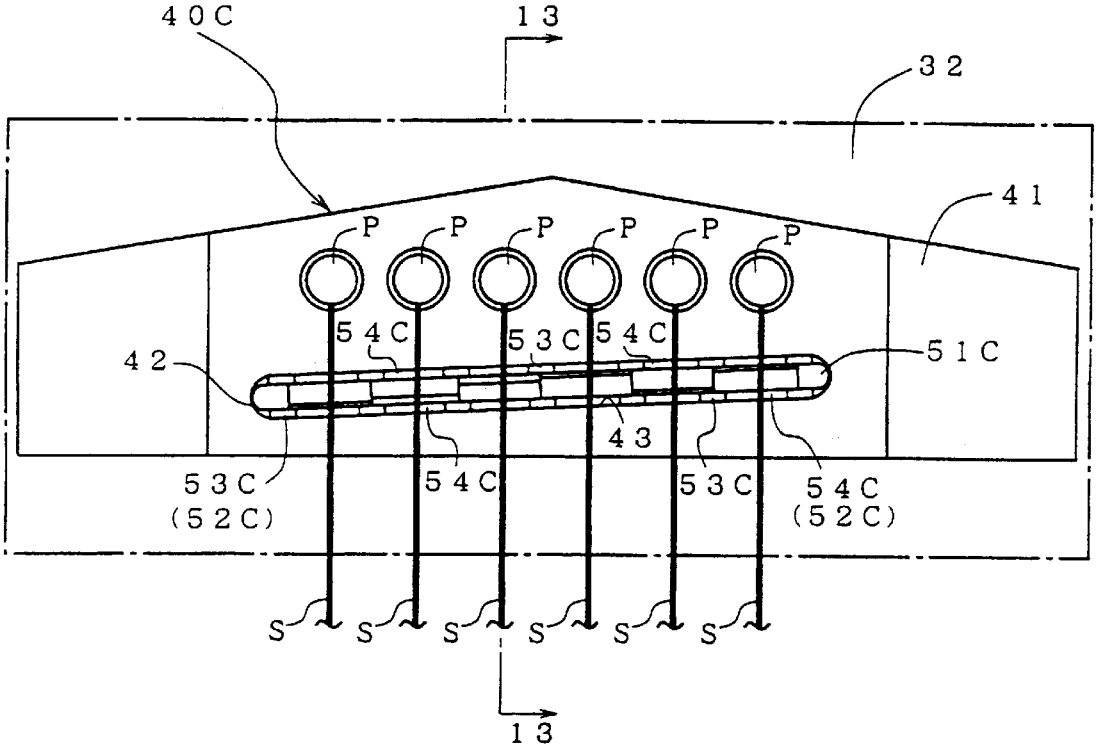
FIG. 12 is a plan view of the bridge mechanism.
Figure 13:
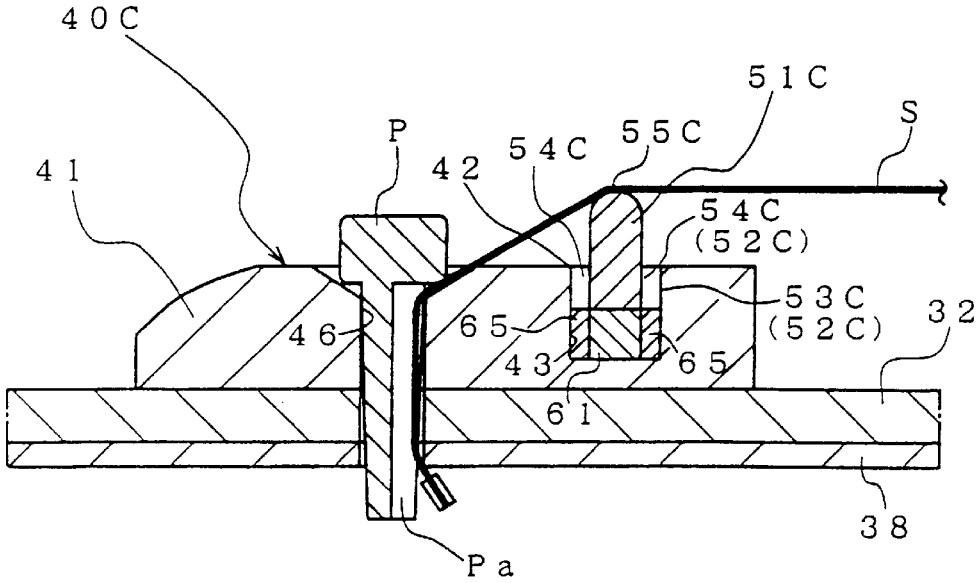
FIG. 13 is a cross section along line 13—13 in FIG. 12.

The bridge mechanism 40C of FIGS. 11 through 13 comprises a main bridge body 41, a string support saddle 51C and a pressure sensitive type pickup 61. The elements here which are the same as for the bridge mechanism 40 in FIGS. 2 through 4 are not described. The features which differentiate the bridge mechanism 40C are explained below.

The bridge mechanism 40C has a plurality of convex parts 53C that contact the inner wall surfaces 43 of the accommodating recess for the string support saddle. The parts 53C are spaced at distances k4 on one or both sides 52C of the string support saddle. Gaps 54C between parts 53C are located approximately directly below each guitar string S at least on the side surface 52 of the string support saddle 51C and at the gaps, the parts 53C may not contact the inner wall surface 43 of the accommodating recess 42.

The distance between the side surface 52C of the string support saddle and the convex parts 53C or the width k4 of the non-contact parts 54C of the string support saddle 51C that do not contact the inner wall surface 43 of the accommodating recess for the string support saddle of the side 52C is determined as to enable minute deformation of the portion of the string support saddle 51C below the string being vibrated.

In addition, the width of each convex 53C is part determined to make the strength of the convex part 53C sufficient.

When the string support saddle 51C is made of a material which is harder than that of the main bridge body 41 and specifically when the string support member 51C is made of urea resin and the main bridge body 41 is made of wood, etc., moreover, there is a need to set the width, of the convex 53C parts to not let the convex 53C parts sink into the inner wall surface 43 of the accommodating recess for the saddle.

There is a string contact part 55 of the string Support saddle 51. Moreover, a resin 65 is charged between the pressure sensitive type pickup 61 and the accommodating recess 42 for the string support saddle of the main bridge body 41 and the pressure sensitive type pickup 61 is fixed inside the accommodating recess for the string support saddle.

The bridge mechanism 40C it makes possible to reduce the damping or the amount of the leakage of the string vibrations to the main bridge body 41, improving the propagation efficiency of the string vibrations to the pressure sensitive pickup 61 and, at the same time, reducing the number of the parts involved.

Figure 14:
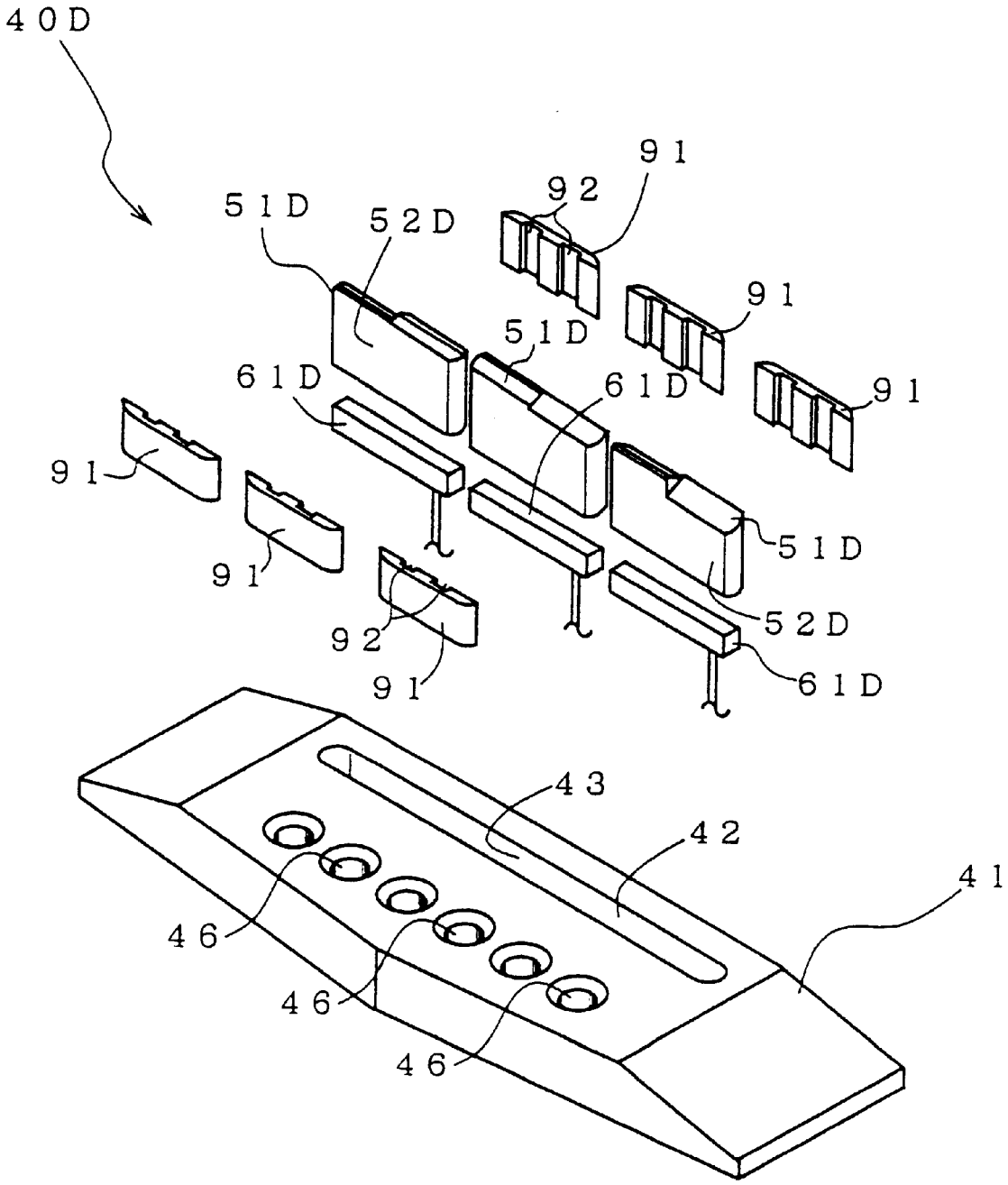
FIG. 14 is an oblique dismantled view of a fifth embodiment of a bridge mechanism.
Figure 15:
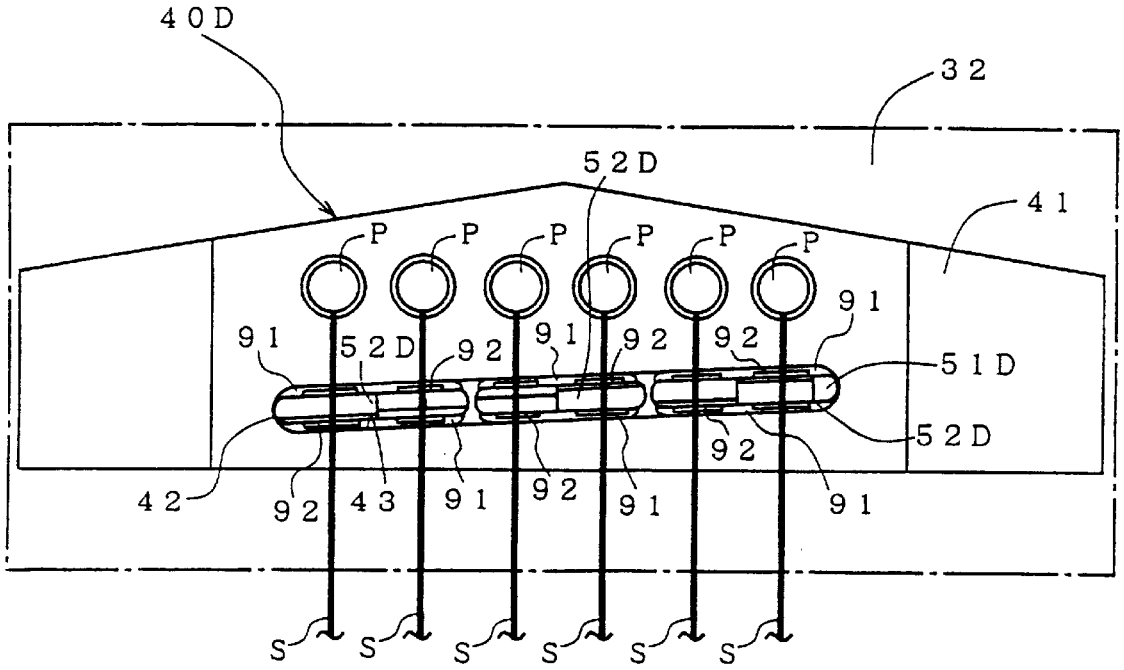
FIG. 15 is a plan view of the bridge mechanism.

In the above described bridge mechanisms 40, 40A, 40B and 40C, moreover-, each of the string support saddle 51 (or 51C) and the pressure sensitive pickup 61 are made of a single member that extends across the entire set of strings S of the guitar. However, these embodiments are not restricted to this. As shown in FIGS. 14 and 15, for example, the string support saddles 51D and the pressure sensitive pickups 61D are divided into two pieces or three pieces, etc. (with three pieces shown).

The bridge mechanism 40D shown includes a plurality of intermediate members 91 having the non-contact regions concaves 92, which do not contact the side surface 52D of the string support saddle. The regions 92 are at locations approximately directly beneath at least each guitar string S between the inner wall surface 43 of the accommodating recess 42 of the main bridge body 41 for the saddle and the side surface 52D of each of the string support saddles 51D.

In FIGS. 14 and 15, those members which are the same as in the bridge mechanism 40 are not described.

In the examples described above, the bridge mechanism that is to be installed in what is called the flat-top guitar, where the distance between each guitar string and the guitar body is comparatively small, has been explained. However, the embodiments which have been described are not restricted to this. They can be applied to the bridge mechanism 40E, shown in FIGS. 16–19, which is capable of string height adjustment. A vertical adjustment mechanism (such as a screw, etc.) R on the main bridge body 41E is installed on an arch top guitar 30E wherein the distance between the guitar string S and the guitar body 31E is comparatively wide, as shown in FIGS. 16 through 19.

Intermediate members 71 having non-contact regions or concaves that do not contact the opposite sides 52 of the string support saddle are provided at locations which are approximately directly beneath at least each guitar string S and are located between the inner wall surface 43E of the accommodating recess 42E of the main bridge body 41E for the string support saddle and the side surface 52 of the string support saddle.

Figure 16:
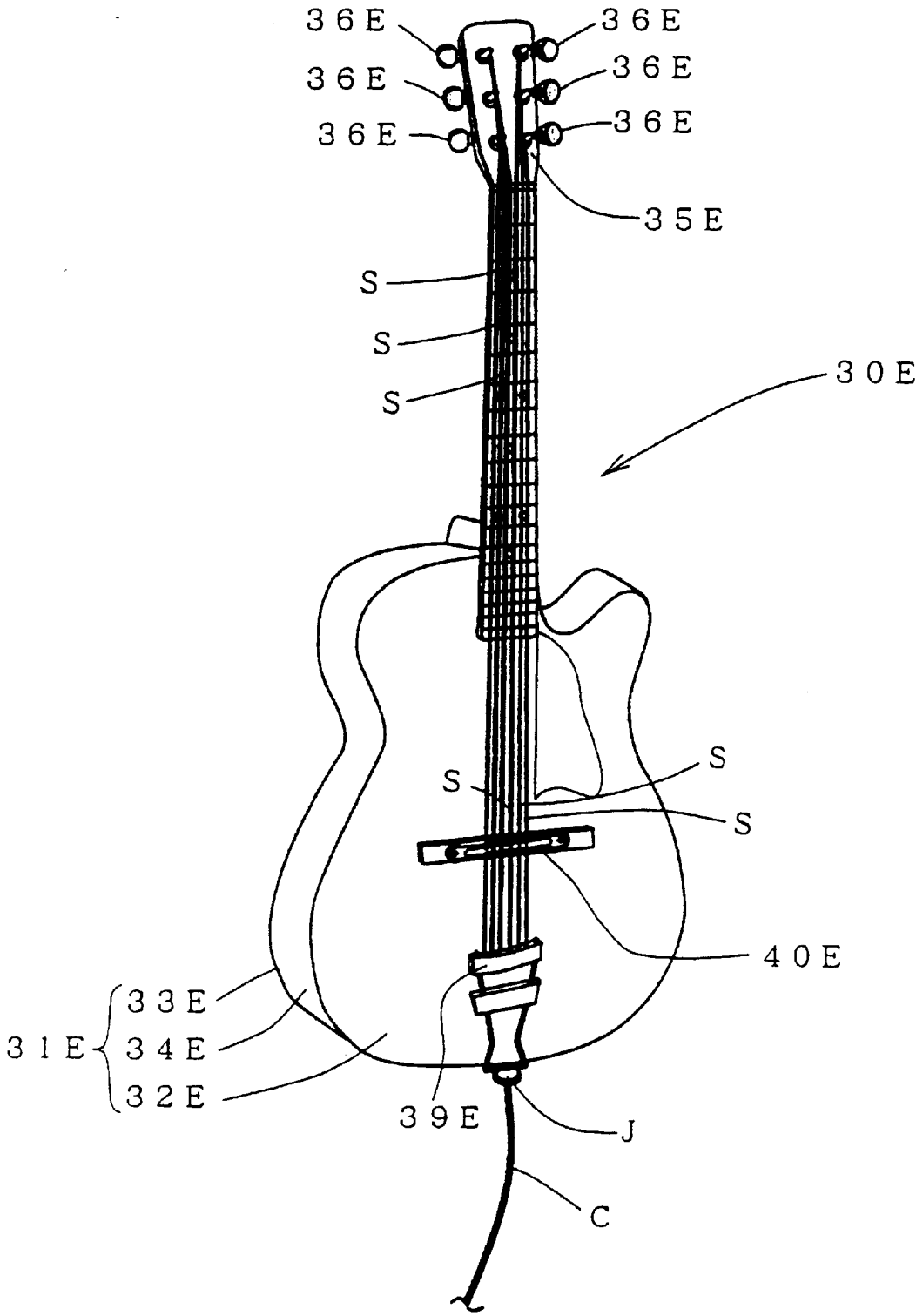
FIG. 16 is an oblique view of an acoustic guitar having a bridge mechanism of a sixth embodiment.
Figure 17:
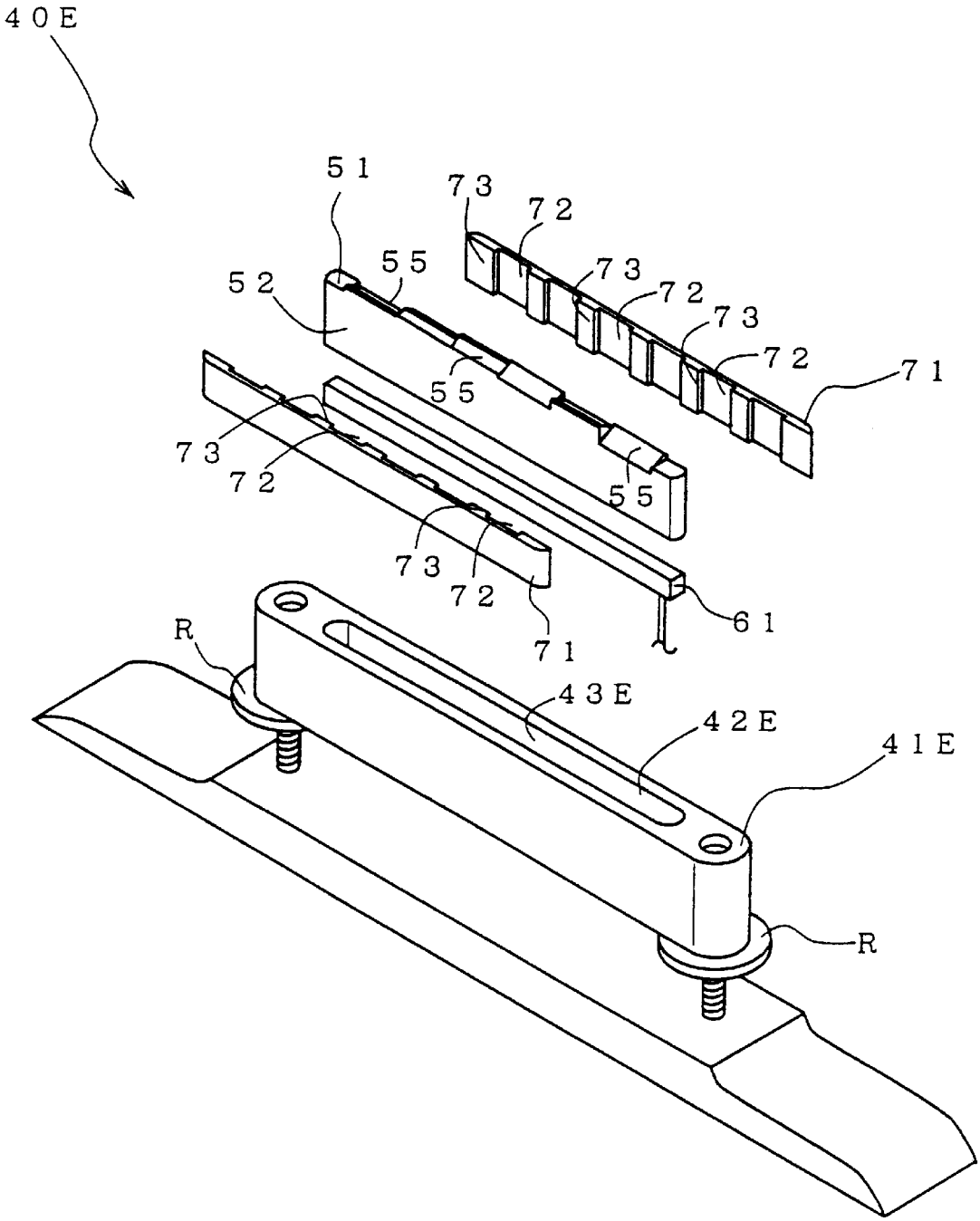
FIG. 17 is an oblique dismantled view of the bridge mechanism.

In FIGS. 16 through 18, the guitar body 31E has a table surface 32E, a table back 32E, a side plate 34E, a head 35E of the guitar 30E, tuning bolts 36E at the head 35E and a string stopper 39E for the guitar strings S.

In FIGS. 16 through 18, the elements which arc the same as in FIGS. 1 through 4 are not explained.

The bridge mechanism according to this invention makes it possible to reduce the amount of the damping or leakage of the string vibrations from the string support saddle to the main bridge body so that the propagation efficiency of the string vibrations to the pressure sensitive pickup is markedly improved. In addition it enables installation of the string support saddle to the main bridge body with sufficient strength.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A bridge mechanism for a guitar, wherein the guitar comprises a body of the guitar, a head of the guitar connected by a neck to the body, guitar strings extending under tensile stress from the body of the guitar over the neck to the head of the guitar; the bridge mechanism for the guitar comprising:

a main bridge body which may be arranged on the guitar body;

the bridge body having a recess which extends across the plurality of strings;

a string support saddle disposed in the recess, the saddle having an edge extending out of the recess and against which the strings arc held by tensile stress such that vibration of each guitar string is transmitted to the saddle;

a pressure sensitive pickup in contact with the saddle for detecting the vibration of the saddle caused by a vibration of at least one of the guitar strings at the saddle;

the recess being having a first surface in the recess facing in the direction of extension of the strings and facing toward the saddle in the recess; the saddle having a second surface thereon also facing in the direction of the extension of the strings and facing opposite to the first surface; at least one of the first and second surfaces being shaped with respect to the other of the first and second surfaces at first regions directly below each of the strings passing over the saddle such that, in the first regions along the saddle across the strings directly below each of the strings, the first and second surfaces are out of contact, while at second regions along the length of the saddle between the first regions and not the directly below the strings, the first and second surfaces are in contact, whereby vibrations of the strings and the saddle at the first regions are not transmitted directly to the bridge body.

2. The bridge mechanism of claim 1, wherein the pressure sensitive pick up is arranged at the bridge body tinder the saddle.

3. The bridge mechanism of claim 2, wherein the pick up is disposed in the recess of the bridge body.

4. The bridge mechanism of claim 2, wherein at least some of the first regions comprise gaps in the respective one of the first and second surfaces having the first region.

5. The bridge mechanism of claim 2, wherein the saddle has opposite side surfaces facing in the direction of extension of the strings and the recess has opposing recess defining walls, with each wall opposite one of the opposite side surfaces of the saddle;

an intermediate member disposed in the recess between one of the side surfaces of the saddle and the opposing recess wall of the recess;

one of the first and second surfaces being on the side surface of the intermediate member and the other of the first and second surfaces being on the saddle and the first regions being in at least one of the saddle and the intermediate member.

6. The bridge mechanism of claim 5, wherein there is a respective intermediate member at both sides of the saddle and each intermediate member is between the side of the saddle and the respective opposing side wall of the recess.

7. The bridge mechanism 6, wherein there is a respective first region beneath the strings at both sides of the saddle and including both of the intermediate members.

8. The bridge mechanism of claim 2, wherein each first region comprises a depression in at least one of the first and second surfaces at each first region.

9. The bridge mechanism of claim 8, wherein each depression comprises a concavity in the respective surface.

10. The bridge mechanism of claim 8, wherein the second regions are convex with respect to the depressions of the first regions.

11. The bridge mechanism of claim 8, wherein the saddle has opposite side surfaces facing in the direction of extension of the strings and the recess has opposing recess defining walls with each wall opposite one of the opposite side surfaces of the saddle;

the first surface being one of the recess defining walls and the second surface being the opposing side surface of the saddle in the recess.

12. The bridge mechanism of claim 11, wherein there are projections on the second surface of the saddle projecting toward the first surface of the recess and the depressions are between the projections on the second surface.

13. The bridge mechanism of claim 8, wherein the bridge body is defined in a plurality of segments thereof each being contacted by at least one of the strings.

14. The bridge mechanism of claim 13, wherein there is a respective plurality of portions of the pickup each positioned to receive vibrations from a respective one of the segments of the saddle.

15. The bridge mechanism of claim 8, wherein the saddle has opposite side surfaces facing in the direction of extension of the strings and the recess has opposing recess defining walls, with each wall opposite one of the opposite side surfaces of the saddle;

an intermediate member disposed in the recess between one of the side surfaces of the saddle and the opposing recess defining wall of the recess;

one of the first and second surfaces being on the side surface of the intermediate member and the other of the first and second surfaces being on the saddle and the first regions being in at least one of the saddle and the intermediate member.

16. The bridge mechanism of claim 15, wherein the intermediate member is in a plurality of sections along the length thereof with each section thereof being at at least one of the first regions.

17. The bridge mechanism of claim 16, wherein the first regions are defined by gaps between adjacent sections of the intermediate member and the sections of the intermediate members include the second regions thereon.

* * * * *